US009605395B1

(12) United States Patent
Hewitt

(10) Patent No.: US 9,605,395 B1
(45) Date of Patent: Mar. 28, 2017

(54) STREET SWEEPER

(71) Applicant: Richard Alston Hewitt, Southaven, MO (US)

(72) Inventor: Richard Alston Hewitt, Southaven, MO (US)

( * ) Notice: Subject to any disclaimer, the term of this patent is extended or adjusted under 35 U.S.C. 154(b) by 0 days.

(21) Appl. No.: 15/055,141

(22) Filed: Feb. 26, 2016

(51) Int. Cl.
*E01H 1/08* (2006.01)

(52) U.S. Cl.
CPC ..... *E01H 1/0818* (2013.01)

(58) Field of Classification Search
CPC ... E01H 1/0818; E01H 1/0836; E01H 1/0827; E01H 1/0854; E01H 1/0845; A47L 11/4044
See application file for complete search history.

(56) References Cited

U.S. PATENT DOCUMENTS 4,099,290 A * 7/1978 Hiszpanski ..... E01H 1/0863 15/340.1
4,359,801 A * 11/1982 Tate ..... E01H 1/0863 15/346
4,807,327 A * 2/1989 Jajko ..... E01H 1/0863 15/346
4,951,347 A * 8/1990 Star ..... E01H 1/0872 15/340.3
5,542,148 A * 8/1996 Young ..... E01H 1/0872 15/340.3
5,852,847 A * 12/1998 Weiss ..... E01H 1/0863 15/340.1
5,884,359 A * 3/1999 Libhart ..... E01H 1/0872 15/340.3
7,621,018 B2 * 11/2009 Libhart ..... E01H 1/0809 15/340.1
2008/0083083 A1 * 4/2008 Schwarze ..... E01H 1/0845 15/340.3
2008/0083084 A1 * 4/2008 Schwarze ..... E01H 1/0863 15/346

* cited by examiner

*Primary Examiner* — Dung Van Nguyen
(74) *Attorney, Agent, or Firm* — Strategy IP, a professional corp.

(57) ABSTRACT

A sweeper head for a motorized street sweeper and methods of use are described. The sweeper head includes a primary deflector located near an air outlet and extending to about 3 to 6 inches from the top wall. Pressurized air is forced through the gap formed between the primary deflector and the surface to be cleaned prior to exiting the sweeper head.

16 Claims, 4 Drawing Sheets

STREET SWEEPER

TECHNICAL FIELD OF THE INVENTION

The present invention is related to a sweeper head of a motorized street sweeper.

BACKGROUND

Cities have long recognized street sweeping as providing both aesthetic and health benefits to its citizens. More recently, removal of small debris from urban streets has been shown to improve water quality by reducing storm runoff pollutants.

Initially, individuals were employed to clean streets of waste, debris, trash, and other undesirable materials using brooms and shovels. Eventually, manpower was replaced by mechanized sweepers, initially horse-drawn, but later mounted on truck bodies (motorized street sweepers). Early mechanized street sweepers utilized rotating brooms to sweep material from the streets.

A motorized street sweeper is a motor vehicle designed to clear streets, pavements, parking lots, and other traffic areas of debris, including litter, waste, and dirt. Some motorized street sweepers include rotary brushes that sweep materials into a holding area. These devices work as rotary brooms that are moved across the surface to be cleaned. While the brushes are able to dislodge and sweep material into the holding area, this type of motorized street sweeper also lifts large amounts of dust into the air, causing a breathing hazard for the operator and anyone in the area being cleaned. To reduce the amount of dust, some motorized street sweepers use water to wet the surface before sweeping, however, this can allow debris to adhere to the surface and not be lifted into the holding area.

Another type of motorized street sweeper uses a vacuum to suck debris into the holding area of the vehicle. A vacuum head is placed near the ground and material is drawn into the vacuum head. Debris is removed from the air stream and the air stream exhausted into the atmosphere. Although the exhaust may be filtered, fine contaminates escape into the air exhausted from the street sweeper.

More recent motorized street sweepers recycle exhaust air. The vehicle includes a blower for delivering pressurized air to one side of a sweeper head while withdrawing air from the opposite side of the sweeper head. The sweeper head directs the pressurized air along the surface of the ground to be cleaned. The debris-laden air is directed back into the vehicle to a separating bin where the debris settles and is collected. After removal of the debris, the exhaust is recirculated back to the blower instead of being released to the atmosphere. The motorized street sweeper can also include spinning brushes or other devices that direct debris toward the sweeper head.

Removal of the debris depends on air flow from an inlet on one side of the top of sweeper head to an outlet on the other side of the top of the sweeper head. The blower creates a positive pressure of air that is forced through the inlet, across the sweeper head, and through the outlet to deliver the debris-laden air to the separating bin. The velocity and angle of the air entering the sweeper head is sufficient to impinge on the surface to be cleaned and remove debris near the inlet. However, the cross-sectional area of the sweeper head may be greater than the cross-sectional area of the inlet, which causes the velocity of the air to decrease. In some cases, a pressure chamber and a suction chamber are located within the sweeper head. The suction chamber increases in cross-sectional area as air flows from the inlet toward the outlet, which reduces air velocity. Impingement of the air stream on the surface to be cleaned further reduces the air velocity of the air stream near the surface, while air not contacting the surface has a higher velocity. Additionally, as the air sweeps across the sweeper head toward the outlet, the air rises away from the surface to be cleaned due to frictional heating with the surface to be cleaned and surfaces of the sweeper head, and also rises in order to take the shortest path toward the outlet. The slowing of the air flow and rising away from the surface to be cleaned causes debris being swept from the inlet side of the sweeper head toward the outlet side to drop out of the air stream, creating a "dead zone" under the outlet having insufficient air flow to lift the debris into the outlet. Furthermore, the velocity of the air may slow sufficiently that even debris located away from the outlet can fail to be swept away. Since the outlet can be located up to 10-12 inches away from the surface, debris under the outlet may not be picked up due to the lack of air velocity at the surface to be cleaned. Furthermore, air from the inlet side of the sweeper head may slow sufficiently prior to reaching the outlet that denser and heavier debris drops out of the air stream before reaching the outlet and is not picked up. These drawbacks can be particularly problematic with leaves and other flat debris, such as paper, which tend to "stick" to the surface to be cleaned.

Some motorized street sweepers use a "pressure bleed" system to help remove leaves and other flat debris. In a pressure bleed system, some of the air leaving the blower is exhausted to the atmosphere. In this manner, more air is being withdrawn from the blower than is delivered to the sweeper head, thus improving the removal of leaves and other flat debris. However, the exhaust from these systems can include micro-fine particulate matter.

The overall design of the sweeper head withdraws air upward and into the outlet. The low air velocity underneath the outlet, coupled with the outlet being located up to 10-12 inches away from the surface to be cleaned, can result in debris under the outlet not being removed. In particular, debris directly below the outlet experiences primarily upward air movement at low velocity. In an effort to remove debris in the dead zone, a motorized sweeper may travel slowly or may make a second pass over the surface. However, this is inefficient and costly. Furthermore, venting of exhaust into the atmosphere exposes operators and bystanders to fine particulate matter.

SUMMARY

The present invention relates to a sweeper head for mounting to a motorized street sweeper. The sweeper head includes a box-shaped body having a top wall, leading wall, trailing wall opposite the leading wall, first side wall, and second side wall opposite the first wall, the box-shaped body defining an open-sided chamber having an open wall opposite the top wall. The sweeper head also includes a primary deflector having an edge, a first opening in the top wall near the first side wall, a second opening in the top wall near the second side wall. The primary deflector is coupled to the top wall along the edge near the first opening. The edge of the primary deflector is perpendicular to the leading and trailing walls, and parallel to the first and second side walls. The primary deflector projects into the open-sided chamber at an angle between about 45 and about 90 degrees away from the second opening.

In other, more detailed features of the invention, the primary deflector includes a proximal end and a distal end.

The primary deflector is coupled to the top wall at the proximal end and the distal end is positioned 6 inches or more from a surface to be cleaned when the sweeper head is in an operative position. In other, more detailed features of the invention, the primary deflector is coupled to the top wall at a distance of less than 6 inches from the first opening and is positioned between the first opening and the second opening.

In other, more detailed features of the invention, the primary deflector abuts the first opening. In still other, more detailed features of the invention, the primary deflector is rectangular in shape. And in further, more detailed features of the invention, the sweeper head includes at least one curtain extending beyond the open wall of the open-sided chamber.

In yet other, more detailed features of the invention, the sweeper head further includes at least two middle curtains. The at least two middle curtains are approximately parallel to the leading wall and the trailing wall and extend from the first side wall to the second side wall. The primary deflector extends from a first of the at least two middle curtains to a second of the at least two curtains.

In still other, more detailed features of the invention, the sweeper head further includes at least one inner deflector coupled to the top wall along an edge of the at least one inner deflector. The primary deflector defines a main section within the chamber and the at least one inner deflector is positioned within the main section. The edge of the at least one inner deflector is parallel to the edge of the primary deflector and the at least one inner deflector projects into the main section at an angle between about 45 and about 90 degrees away from the second opening. In other, more detailed features of the invention, the sweeper head includes two inner deflectors. In other, more detailed features of the invention, the at least one inner deflector is rectangular in shape.

The present invention also relates to a method of using a sweeper head mounted to a motorized street sweeper. The method includes blowing high-velocity air through a sweeper head, forcing the high-velocity air through at least one gap within the sweeper head, and removing debris entrained in the high-velocity air from a surface underneath the sweeper head. The sweeper head includes a primary deflector.

The present invention also relates to a motorized street sweeper. The motorized street sweeper includes a motorized vehicle, a sweeper head coupled to the underside of the motorized vehicle, and a primary deflector located within the sweeper head. The motorized vehicle includes a source of high-velocity air that enters the sweeper head through an inlet and exits through an outlet. The primary deflector is positioned between the outlet and the inlet.

Other features of the invention should become apparent to those skilled in the art from the following description of the preferred embodiment(s) taken in conjunction with the accompanying drawings, which illustrate, by way of example, the principles of the invention, the invention not being limited to any particular preferred embodiment(s) disclosed.

BRIEF DESCRIPTION OF THE DRAWINGS

These and other features, aspects, and advantages of the present invention will become better understood with reference to the following description, appended claims, and accompanying drawings, where:

Unless otherwise indicated, the illustrations in the above figures are not necessarily drawn to scale.

DETAILED DESCRIPTION OF THE PREFERRED EMBODIMENTS

All of the features disclosed in the specification, including the claims, abstract, and drawings, and all of the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise. Thus, unless expressly stated otherwise, each feature disclosed is one example only of a generic series of equivalent or similar features.

Figure 1:
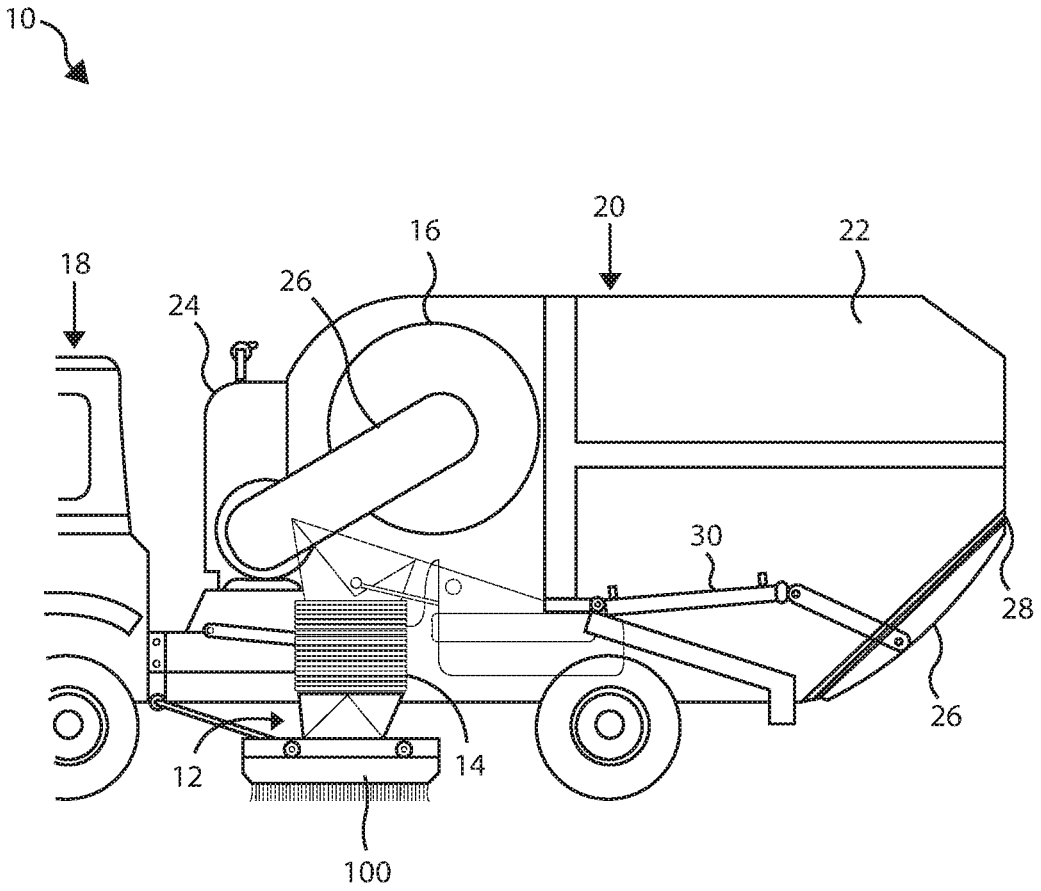
FIG. 1 is a side elevational view of a motorized sweeper with a sweeper head according to the present invention.

FIG. 1 is an embodiment of a motorized street sweeper, shown generally at 10, according to the present invention. As shown, the motorized street sweeper 10 is a unitary vehicle, such as a truck. Alternatively, the motorized portion 18 of the vehicle can be separated from the street sweeper portion 20, for example, the motorized portion 18 can be a pickup truck that pulls a trailer including the street sweeper portion 20.

Sweeper portion 20 includes a blower 16, a solids collection bin 22, and a sweeper head 100. Blower 16 provides pressurized air to sweeper head 100 and is driven by engine 24, whose power output is transmitted by belts and pulleys located within housing 26.

Details of air flow within sweeper head 100 is described below, however, generally, pressurized air from the output side of blower 16 flows through duct 14 and into one end of sweeper head 100. A return duct, not shown, on the other end of the sweeper head 100 withdraws air from sweeper head 100 and leads into solids collection bin 22. Mechanical and/or centrifugal filters remove debris from the air before it returns to the input of blower 16. Because the return duct is ultimately coupled with the input of blower 16, air flows in essentially a closed system, i.e., the amount of air entering the sweeper head from blower 16 is equal to the amount of air returned to blower 16, there is no dust-laden exhaust.

Sweeper head 100 is positionable under motorized street sweeper 10. Sweeper head 100 can be raised or lowered mechanically using springs and levers, located between the sweeper head and the underneath of the vehicle, to accommodate various surfaces or to move sweeper head to a non-functioning position for transport. The raising/lowering mechanism 12 can be manually operated or operated using a motor or pneumatic system. Additionally, sweeper head 100 can be positionable relative to motorized street sweeper 10. In some uses, sweeper head 100 can be positioned closer to the curb-side of the vehicle, while in other uses, having sweeper head 100 located centrally or on the driver-side of the vehicle may be advantageous.

Solids collection bin 22 includes a door 26 at the rear for removal of debris. Door 26 is hinged along the top end 28 allowing debris to fall out of solids collection bin 22. As shown, pneumatic pistons 30 can be used to open door 26.

Figure 2:
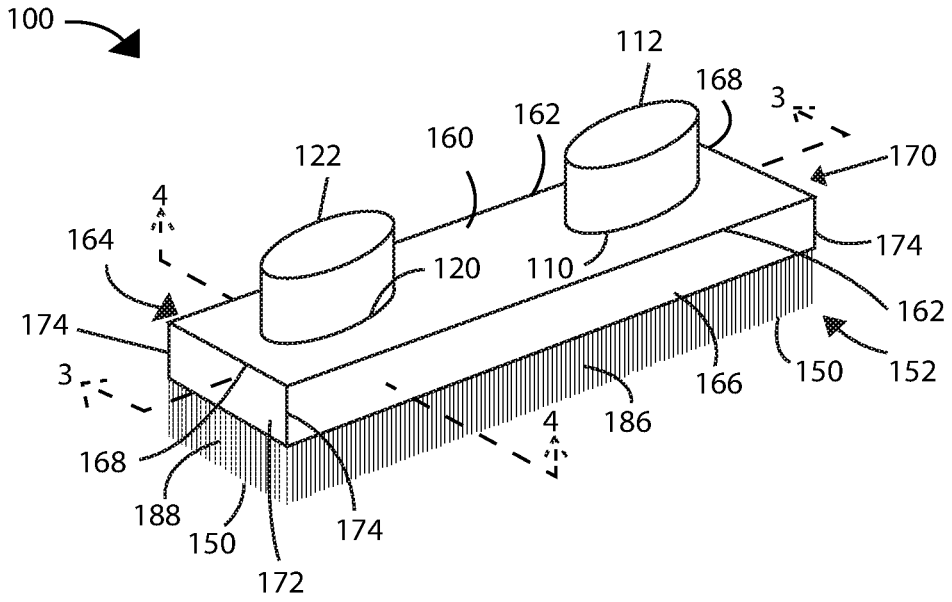
FIG. 2 is a top perspective view of a first embodiment of a sweeper head according to the present invention.
Figure 3:
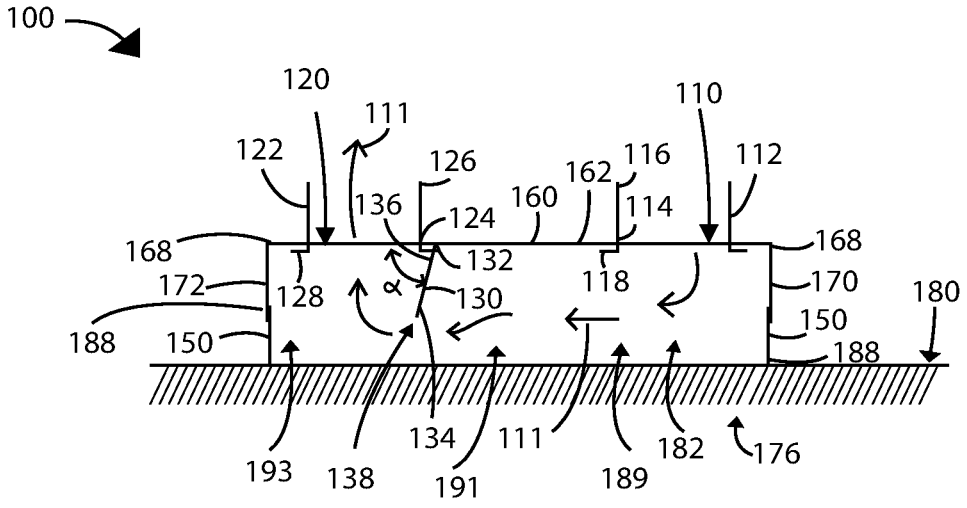
FIG. 3 is a sectional view of the sweeper head shown in FIG. 2 taken along line 3-3.
Figure 4:
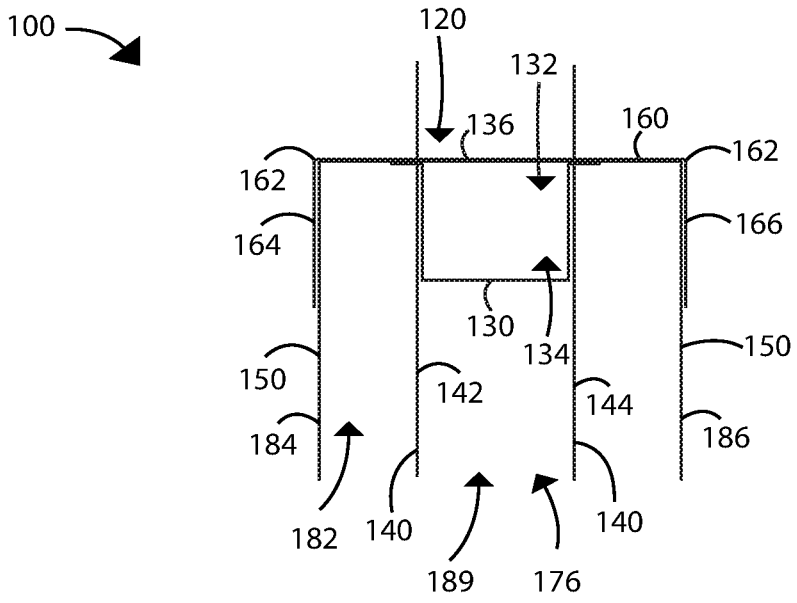
FIG. 4 is a sectional view of the sweeper head shown in FIG. 2 taken along line 4-4.

As shown in FIGS. 2-4, a first embodiment of a sweeper head 100 of the present invention is designed to be affixed or attached underneath a conventional motorized street sweeper 10, either permanently by welding, for example, or removably by bolts, for example, for easy replacement and maintenance. The sweeper head 100 includes an air inlet 110, and air outlet 120, and at least one primary deflector 130. The sweeper head 100 also includes middle curtains 140 and outer curtains 150 that loosen debris and contain the airflow underneath the sweeper head 100.

The sweeper head 100 is box-shaped and includes a rectangular top wall 160. Edges 162 of a rectangular leading wall 164 and a rectangular trailing wall 166 are coupled perpendicularly to opposite long edges of the top wall 160. Edges 168 of rectangular first 170 and second 172 side walls are coupled perpendicularly to opposite short edges of the top wall 160. Side edges 174 of the leading 164 and trailing 166 walls are coupled to adjacent edges of the first 170 and second 172 side walls to form the body of the box-shaped sweeper head 100. The sweeper head 100 is generally open on the bottom, having an opening 176 opposite the top wall 160. The bottom of the sweeper head 100 is that portion closest to the surface to be cleaned 180 and the top is generally proximal to the motorized street sweeper 10. Leading and trailing directions are relative to the motorized street sweeper 10 when being operated to remove debris, the leading direction being generally toward the front of the street sweeper 10 and the trailing direction being generally toward the back of the street sweeper 10. One side wall is proximal to the driver's side of the motorized street sweeper 10, and the other side wall distal to the driver's side of the street sweeper 10, generally the side closest the curb or shoulder of the street. The top 160, leading 164, trailing 166, first 170, and second 172 side walls define an open-sided chamber 182 within the sweeper head 100.

The sweeper head 100 can be fabricated from any suitable type of sheet material, for example, sheet metal, rigid plastics, wood, composites, mixtures thereof, etc. The sheet material can include structural ribs for rigidity and strength, or may be sufficiently thick for rigidity. The sweeper head 100 can be a unitary construction, being cut from a single sheet of metal, for example, and bent into shape, or be made of several pieces coupled together. Portions of the sweeper head 100 can be coupled to one another by conventional means, such as welding, gluing, riveting, etc., or be held in place by screws, or nuts and bolts. Suitable glues can include various epoxy glues, for example.

Attached to the bottom perimeter of the sweeper head 100 are curtains 150. Leading 184 and trailing 186 curtains are attached to the leading 164 and trailing 166 walls, respectively, and extend the length of the leading 164 and trailing 166 walls. The leading 184 and trailing 186 curtains can be made of any heavy, flexible, durable material such as solid, thick rubber or mesh. Side curtains 188 are attached to the first 170 and second 172 side walls and may extend beyond the ends of the first 170 and second 172 side walls. In particular, side curtains 188 extending beyond the leading wall 164 and leading curtain 184 can help to contain larger pieces of debris until it is removed manually or enters the sweeper head 100. Side curtains 188 can be made of similar materials as the leading 184 and trailing 186 curtains and be solid sheets of material or cut into finger-like projections.

Figure 5:
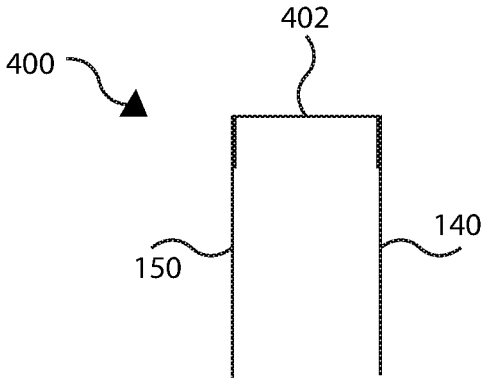
FIG. 5 is a side elevational view of a curtain fixture for use in the sweeper head shown in FIG. 2.

In addition, there are two middle curtains 140 within the chamber of the sweeper head 100. The middle curtains 140 define a central compartment 189 within the chamber 182, extend from one side wall 170 to the opposite side wall 172, and are approximately parallel to the leading 164 and trailing 166 walls. A leading middle curtain 142 is positioned closer to the leading wall 164 and a trailing middle curtain 144 is positioned closer to the trailing wall 166. The middle curtains 140 may be separate curtains, or each middle curtain may be part of a curtain fixture 400 (see FIG. 5) that includes a corresponding leading 150 and trailing 140 curtain attached to a hanger 402. The middle curtains 140 are positioned such that the air inlet 110 and air outlet 120 are located between the middle curtains 140. Middle curtains 140 can be made of the same materials as the leading 164 and trailing 166 curtains, and can be cut into finger-like projections.

The length of the curtains 140, 150 may vary, however, the length is sufficient that the curtain engages the surface to be cleaned 180 when the sweeper head 100 is in the operative position. Thus, the lower portion 152 of the curtains 140, 150 is in contact with the surface to be cleaned 180 during operation of the sweeper head 100, loosening debris and reducing or eliminating the amount of air that can escape from the sweeper head 100. Any or all of the curtains 140, 150, or curtain fixtures 400, can be removably attached to the sweeper head 100. Removably attaching curtains 140, 150 allows for easy replacement when the curtains wear out from being in contact with the surface to be cleaned 180.

The air inlet 110 is an opening in the top wall 160 at, or near, the first side wall 170 and between the leading 142 and trailing 144 middle curtains that allows pressurized air from the blower 16 on the motorized street sweeper 10 to enter the chamber 182. The opening can be spaced from 0 to about 6 inches from the first side wall 170. The inlet 110 may include an inlet fitting 112 that connects a duct 14 from the blower 16 to the sweeper head 100. The inlet fitting 112 includes an end 114 adjacent the top wall 160 and an end 116 distal to the top wall 160. The end 114 adjacent the top wall 160 can include a flange 118 for coupling the fitting 112 to the top wall 160.

The air outlet 120 is an opening in the top wall 160 at, or near, the second side wall 180 and between the leading and trailing middle curtains that allows pressurized air to exit the chamber 182 and enter the separating bin where suspended debris is removed. The outlet 120 may include an outlet fitting 122 that connects a duct (not shown) from the sweeper head 100 to the separating bin. The outlet fitting 122 includes an end 124 adjacent the top wall 160 and an end 126 distal to the top wall 160. The end 124 adjacent the top wall 160 can include a flange 128 for coupling the fitting to the top wall 160.

Inlet and outlet fittings 112, 122 can be coupled to the top wall 160 by any known means. For example, the flanges 118, 128 on the fittings 112, 122 can be welded to the top wall 160, at either the inside of the chamber 182 or the outer surface 158 of the top wall 160. Other ways to fasten the flanges 118, 128 include the use of glues, rivets, screws, bolts, etc. The coupling should be sufficient to prevent the flanges 118, 128 from being broken off the top wall 160 and to minimize air leakage. Gaskets made of rubber, leather, plastic, or other materials can be used between the top wall 160 and flanges 118, 128 to reduce air leakage.

The air inlet 110 and air outlet 120 can be any shape. For example, the inlet 110 and outlet 120 can be round or circular, oval, square, rectangular, other polygonal shape, etc. The inlet 110 and outlet 120 can be the same shape or different shapes. There can be a great deal of variation in size and capacity of blowers used in motorized sweepers 10, so the air inlet 110 can be sized relative to the air moving capacity of the blower so that the air passing through the inlet 110 from the blower 16 is at high velocity, for example, greater than about 50 to 60 mph. Similarly, the opening for the air outlet 120 is sized so that the air passing through the outlet 120 from the chamber 182 is at high velocity, for example, greater than about 50 to 60 mph. However, it is within the scope of the invention that air entering or exiting air inlet 110 or air outlet 120 can be at lower velocities.

The shape and size of the end of the inlet fitting 112 and outlet fitting 114 adjacent the top wall 160 is similar to the shape of the inlet 110 and outlet 120, respectively. The size can be slightly smaller if the flange 118, 128 of the fitting 112, 114 is coupled to the top wall 160 inside the chamber 182. The distal end 116, 126 of the fitting 112, 122 is shaped and sized for attachment to corresponding ducts. The size and shape of the two ends of the fittings 112, 114 can be different.

The sweeper head 100 also includes a primary deflector 130 having proximal 132 and distal 134 ends. The proximal end 132 of the primary deflector 130 is attached to the top wall 160 along an edge 136 of the primary deflector 130 at a location near the outlet 120 and between the outlet 120 and inlet 110. When the primary deflector 130 is attached to the top wall 160, the attached edge 136 of the primary deflector 130 is approximately perpendicular to the leading 164 and trailing 166 walls and approximately parallel to the first 170 and second 172 side walls. The distance between the outlet 120 and the primary deflector 130 ranges from 0 to about 6 inches. The distal end 134 of the primary deflector 130 projects into the chamber 182 at an angle $\alpha$ relative to the top wall 160 ranging from about 90 degrees, or about perpendicular, to about 45 degrees in the direction away from the inlet 110 and toward the outlet 120. The position of the distal end 134 creates a gap 138 through which air from the blower 16 must pass to reach the outlet 120. The primary deflector 130 divides the central compartment 189 into a main section 191 including the inlet 110 and an outlet orifice 193 including the outlet 120. In this embodiment, the primary deflector 130 is generally planar and rectangular in shape, spanning the distance between the leading and trailing middle curtains 142, 144. However, it is within the scope of the invention that the attached edge 136 can be non-linear, for example, curved, zig-zagged, etc., the attached edge 136 can be non-perpendicular to a side wall, and the primary deflector 130 can be non-planar and/or non-rectangular in shape. The distance that the primary deflector 130 extends into the chamber 182 is dependent on the dimensions of the sweeper head 100. The distance is sufficient to position the distal end 134 of the primary deflector 130 about 3 to 6 inches from the top wall 160. The thickness of the primary deflector 130 can vary depending on the material from which the primary deflector 130 is made. In general, the thickness is about ½ inches.

Figure 6:
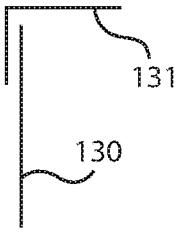
FIG. 6 is a side elevational view of a mounting bracket and deflector for use in the sweeper head shown in FIG. 2.

The primary deflector 130 can be made from various materials. Examples of materials suitable for the primary deflector 130 include rubber, metals, plastic, etc. The primary deflector 130 redirects air, so the material chosen should be able to withstand air and suspended debris. Rubber, particularly hard rubber or vulcanized rubber, is resilient, pliable, and can lessen the noise associated with deflecting debris. Additionally, the primary deflector 130 can be attached to a mounting bracket 131 as shown in FIG. 6. The mounting bracket 131 can be metal or other rigid material onto which the primary deflector 130 can be removably mounted to the top wall 160. If the primary deflector 130 is damaged or wears out, it can easily be changed.

In operation, pressurized air (as shown by arrows 111 in FIG. 3) is forced from the blower 16 through the inlet 110. As described previously, the pressurized air enters the sweeper head 100 at high velocity and is directed downward to impinge on the surface to be cleaned 180. The air travels across the sweeper head 100 in the main section 191 from the inlet 110 toward the outlet 120 and in doing so, causes the debris to become airborne in the stream of air. As the stream of air moves across the sweeper head 100, it is forced back toward the surface to be cleaned 180 by the primary deflector 130. By placing the distal end 134 of the primary deflector 130 about 3-6 inches from the top wall 160, or about 6-9 inches from the surface to be cleaned 180, the velocity of the flowing air is increased as it passes through the gap 138 formed between the primary deflector 130 and the surface to be cleaned 180 and enters the outlet orifice 193. In some embodiments, the distal end 134 of the primary deflector 130 can be about 1.5-2 inches from the top wall 160, however, deflection of the air stream may be insufficient. Additionally, in some embodiments, the distal end 134 of the primary deflector 130 can be positioned 5 inches from the surface to be cleaned 180, however, large debris may not pass through the gap 138. Additionally, the redirection of the air stream by the primary deflector 130 may cause turbulent flow in the outlet orifice 193, helping to keep debris suspended and flowing toward the outlet 120.

By forcing the air stream down toward the surface to be cleaned 180 and through the gap 138, the air flow in the dead zone is increased and debris in the dead zone is forced upward toward the outlet 120. The high velocity of the air passing through the gap 138 prevents debris from dropping out of the air stream and picks up any debris that may be directly under the outlet 120. By eliminating the dead zone, motorized sweepers 10 can operate at higher speeds and avoid multiple passes over the surface to be cleaned 180 thereby lowering costs and reducing the time required to clean.

Figure 7:
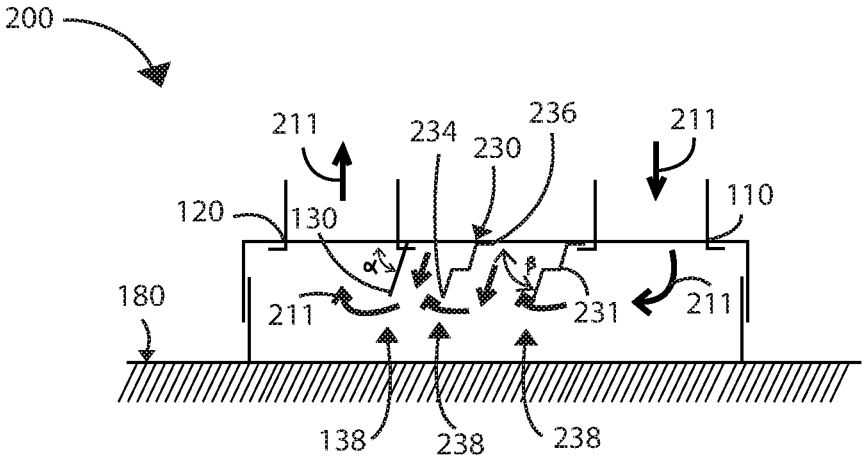
FIG. 7 is a sectional view similar to FIG. 3 of a second embodiment according to the present invention.

FIG. 7 depicts a second embodiment of a sweeper head 200 of the present invention that is much like the first embodiment. Sweeper head 200 further includes one or more inner deflectors 230 that are located within the main section 191 of the central compartment 189. The inner deflectors 230 are coupled to the top wall 160 along an edge 236 of each inner deflector 230 in the same manner as the primary deflector 130 and can be made of similar materials. The edges 236 of the inner deflectors 230 are approximately parallel to the edge 136 of the primary deflector 130. The inner deflectors 230 project downward from the top wall 160 into the chamber 182 at an angle $\beta$ ranging from about 90 degrees, or perpendicular, to about 45 degrees in the direction away from the inlet 110. In one embodiment the angle $\beta$ is about 45 degrees in the direction away from the inlet 110. Each inner deflector 230 extends from the leading curtain 184 to the trailing curtain 186 and projects downward to about 3-6 inches away from the top wall 160. The inner deflectors 230 can be planar like the primary deflector 130, or as is shown in FIG. 7, inner deflectors 230 can be angular and include several bends 231. Bends 231 create a gradual stepdown shape in the inner deflector 230 that creates negative pressure, smoother air flow, and helps to keep the sweeper head 200 against the surface to be cleaned 180. It is also within the scope of the invention that inner deflectors 230 may other shapes, for example, inner deflectors 230 may be curved or arcuate, zig-zag-shaped, etc.

The inner deflectors 230 function in a similar manner as the primary deflector 130, forcing pressurized air (shown as arrows 211 in FIG. 7) from the top of the sweeper head 200 towards the surface to be cleaned 180. The restricted opening 238 formed between the end 234 of the inner deflector 230 and the surface to be cleaned 180 increases the velocity of the air stream and may increase turbulence to keep suspended debris from settling and to pick up additional debris. By including several inner deflectors 230, a higher, more consistent velocity of the air flow can be maintained across the sweeper head 200.

Inner deflectors 230 can be made of the same materials as primary deflector 130, or they can be made of different materials. Suitable materials include rubber, metals, plastic, etc. The inner deflectors 230 should be rigid enough to deflect air flow, but sufficiently resilient to prevent breakage of the inner deflectors 230 if struck by debris.

If only one inner deflector 230 is used, it can be located about midway between the inlet 110 and outlet 120. If more than one inner deflector 230 is used, the first inner deflector 230 is located about 1 foot from the inlet 110 and offset in the direction of the outlet 120. Additional inner deflectors 230 can be placed about 3-4 feet apart. In one embodiment, there are two inner deflectors 230, the first about 1 foot from the inlet and the second about 3-4 feet from the first inner deflector 230.

As described herein, the sweeper head has a general box-shape that can also be described as an open rectangular prism. Other open prism shapes are encompassed by the present invention. For example, the box-shape can be hexagonal, octagonal, and other open prism shapes. Additionally, although the primary deflector and inner deflectors have been described as planar, the primary deflector and inner deflectors may have other shapes, such as curved or bent.

The foregoing detailed description of the present invention is provided for purposes of illustration, and it is not intended to be exhaustive or to limit the invention to the particular embodiments disclosed. The embodiments may provide different capabilities and benefits, depending on the configuration used to implement the key features of the invention. Accordingly, the scope of the invention is defined only by the following claims.

I claim:

1. A sweeper head for mounting to a motorized street sweeper, the sweeper head comprising:

a top wall defining a first opening and a second opening and having a bottom side;

a leading wall coupled to the bottom side of the top wall;

a trailing wall coupled to the bottom side of the top wall opposite the leading wall;

a first side wall coupled to the bottom side of the top wall near the first opening, the first side wall further coupled to the leading wall and the trailing wall;

a second side wall coupled to the bottom side of the top wall near the second opening, the second side wall opposite the first side wall and further coupled to the leading wall and the trailing wall; and a primary deflector positioned between the first opening and the second opening, the primary deflector coupled to the bottom side of the top wall near the first opening and projecting away from the bottom side of the top wall at an angle $\alpha$ between about 45 and about 90 degrees toward the first opening.

2. The sweeper head of claim 1, wherein:

the primary deflector includes a proximal end and a distal end;

the primary deflector is coupled to the top wall at the proximal end; and the distal end is positioned approximately 3 to 6 inches from the top wall.

3. The sweeper head of claim 1, wherein the primary deflector is coupled to the top wall at a distance of 6 inches or less from the first opening.

4. The sweeper head of claim 1, wherein the primary deflector abuts the first opening.

5. The sweeper head of claim 1, wherein the primary deflector is substantially rectangular in shape.

6. The sweeper head of claim 1, wherein the leading wall has a distal end opposite the top wall, the sweeper head further comprising a curtain extending beyond the distal end of the leading wall.

7. The sweeper head of claim 6, further comprising:

a first middle curtain positioned between the leading wall and the first opening; and a second middle curtain positioned between the trailing wall and the first opening;

wherein the primary deflector extends from the first middle curtain to the second middle curtain.

8. The sweeper head of claim 1, further comprising an inner deflector having a coupled edge and a projecting edge, the coupled edge coupled to the top wall in a location between the primary deflector and the second opening, and the projecting edge projecting at an angle $\beta$ of between about 45 and 90 degrees from the top wall and away from the second opening.

9. The sweeper head of claim 8, wherein the inner deflector is a first inner deflector, the sweeper head further comprising a second inner deflector coupled to the top wall in a location between the first inner deflector and the second opening.

10. The sweeper head of claim 8, wherein the inner deflector is substantially rectangular in shape.

11. The sweeper head of claim 8, wherein the projecting edge of the inner deflector is between about 3 to 6 inches from the top wall.

12. A motorized street sweeper comprising:

a motorized vehicle;

a blower coupled to the motorized vehicle; and a sweeper head coupled to the underside of the motorized vehicle, the sweeper head comprising:

a top wall defining a first opening and a second opening and having a bottom side;

a leading wall coupled to the bottom side of the top wall;

a trailing wall coupled to the bottom side of the top wall opposite the leading wall;

a first side wall coupled to the bottom side of the top wall near the first opening;

the first side wall further coupled to the leading wall and the trailing wall;

a second side wall coupled to the bottom side of the top wall near the second opening, the second side wall opposite the first side wall and further coupled to the leading wall and the trailing wall; and a primary deflector positioned between the first opening and the second opening, the primary deflector coupled to the bottom side of the top wall near the first opening and projecting away from the bottom side of the top wall at an angle $\alpha$ between about 45 and about 90 degrees toward the first opening, wherein the blower is coupled in fluid communication with the first opening and the second opening, such that air from the blower enters the sweeper head through the second opening in the top wall and exits the sweeper head through the first opening in the top wall.

13. The motorized street sweeper of claim 12, further comprising:

a first middle curtain positioned between the leading wall and the first opening; and a second middle curtain positioned between the trailing wall and the first opening;

wherein the primary deflector extends from the first middle curtain to the second middle curtain.

14. The motorized street sweeper of claim 12, further comprising an inner deflector having a coupled edge and a projecting edge, the coupled edge coupled to the top wall in a location between the primary deflector and the second opening, and the projecting edge projecting at an angle β of between about 45 and 90 degrees from the top wall and away from the second opening.

15. The motorized street sweeper of claim 14, wherein the sweeper head is coupled to the motorized vehicle such that the projecting edge of the inner deflector is positioned about 6 to 9 inches from a surface to be cleaned beneath the motorized street sweeper.

16. The motorized street sweeper of claim 12, wherein the sweeper head is coupled to the motorized vehicle such that distal end of the primary deflector is positioned approximately 6 to 9 inches from a surface to be cleaned beneath the motorized street sweeper.

* * * * *